US005345874A

United States Patent [19]

Lemonnier et al.

[11] Patent Number: 5,345,874

[45] Date of Patent: Sep. 13, 1994

[54] AUTOMATIC EJECTION SYSTEM FOR TRIP-WIRE TYPE MINES

[75] Inventors: Georges G. Lemonnier, Arcay; Bernard R. Roumat, Trouy, both of France

[73] Assignee: Giat Industries, Versailles, France

[21] Appl. No.: 888,595

[22] Filed: May 27, 1992

[30] Foreign Application Priority Data

Jun. 11, 1991 [FR] France ..... 91 07046

[51] Int. Cl.[5] ..... F42B 23/00

[52] U.S. Cl. ..... 102/424; 102/401; 102/404

[58] Field of Search ..... 102/401, 404, 424–429

[56] References Cited

U.S. PATENT DOCUMENTS 3,498,219 3/1970 Axelson ..... 102/424
3,673,963 7/1972 McGowan ..... 102/504
3,964,392 6/1976 Kintish et al. ..... 102/404
4,391,198 7/1983 Auge ..... 102/401
4,402,271 9/1983 Herdman et al. ..... 102/401

FOREIGN PATENT DOCUMENTS 3338936 5/1985 Fed. Rep. of Germany ..... 102/427

*Primary Examiner*—Harold J. Tudor
*Attorney, Agent, or Firm*—Oliff & Berridge

[57] ABSTRACT

A trip wire type mine has a plurality of trip wires, each trip wire being wound on a reel and ejected through an opening in a body of the mine by means of an ejection system. The ejection system may include a cutting device to cut a lid in a plate forming a plane wall of the hollow body of the mine, a movable system to displace the cutting device, and a pyrotechnic charge to drive the movable system. A projectile is attached to one end of each trip wire, and the charge is also used to eject the plurality of projectiles through the opening, thereby deploying the trip wires and placing the mine in an operational state.

25 Claims, 4 Drawing Sheets

AUTOMATIC EJECTION SYSTEM FOR TRIP-WIRE TYPE MINES

BACKGROUND OF THE INVENTION

The present invention relates to a mine with trip wires, comprising a hollow body containing a plurality of trip wires, each trip wire rolled onto a reel, and an automatic ejection system for said trip wires. The automatic ejection system comprises a device to create an opening in one wall of the body of the mine, a projectile attached to one free end of each trip wire, and means for ejecting the projectiles through the opening in the body of the mine, with simultaneous unreeling of the wires wound on the reels.

A mine of the type outlined above is generally launched by a vector, such as a filling shell or the like, and generally has two plane parallel faces connected by a cylindrical wall, so that it rests flat on the ground on one of its two faces after launching. Once the mine has come to rest on the ground, the trip wires are deployed by the automatic ejection system, making the mine operational, so that it is capable of detonating if a foreign body contacts or strikes one of the trip wires.

A mine of this type is described in particular in document DE-37 13424, wherein the opening through which the projectiles are ejected comprises a plurality of openings formed in the cylindrical side wall of the body of the mine. Each opening opens into a recess in which the trip wire, the projectile, and the ejection system for this projectile, comprising at least one compressed spring, are located. Each opening is closed by a flap mounted on the end of a pivoting arm which is urged by a spring to tilt toward the exterior of the body of the mine to an open position, in order to clear the opening and cause the projectile to be ejected as a result of the release of its associated spring. The arm assembly is held in place by a ring placed around the body of the mine, which holds the flaps in the closed position. Once the mine has come to rest on the ground, the ring is automatically cut, allowing the arms to move to the open position.

In document EP-0 389 852, which describes a mine of the type described in the above-cited document, the reel, which itself forms the projectile, and its ejection system, composed of a pyrotechnic charge, are integral with the flap. In this case, tilting of the flaps permits each reel and its ejection system to come free of the body of the mine before being triggered.

Generally speaking, mines described in these prior documents pose the disadvantage of involving arm-deploying devices located outside the body of the mine and therefore vulnerable during maintenance and storage operations. In addition, after these mines are launched and land on the ground, irregularities in the terrain may prevent deployment of the arms. Finally, the constant urging of these arms by the springs complicates the structure of these mines as well as the assembly operations required for their manufacture.

SUMMARY OF THE INVENTION

It is therefore an object of the present invention is to overcome the disadvantages posed by the ejection systems of the trip wires of these conventional mines, while gaining additional advantages.

To this end, the present invention proposes a mine of the type recited hereinabove, wherein the device for triggering the opening for ejection of the projectiles comprising a cutting means located in the body of the mine for cutting, in one wall of said mine, a portion that forms a lid having the dimensions of the opening, and a device for ejecting the lid.

A mine according to the present invention equipped with such trip-wire ejection systems, has no element capable of causing it to function in an inadvertent or accidental fashion, and has a simple and inexpensive design.

BRIEF DESCRIPTION OF THE DRAWINGS

Other advantages, characteristics, and details of the invention will follow from the explanation below with reference to the attached drawings, provided exclusively as examples, wherein.

DETAILED DESCRIPTION OF PREFERRED EMBODIMENTS

The trip-wire ejection system is located entirely inside the body of the mine, with the opening required for ejection of the projectiles being formed and cleared only after the mine is resting on the ground after being launched. The lid-cutting means comprises a plate abutting a flat surface of the body of the mine and integral with a movable system. The movable system is moved along an axis perpendicular to the plate and passing through the center thereof, and comprises the lid ejection system. The movable system comprises at least one piston integral with the cutting plate and driven translationally by the pressure of gases resulting from the triggering of a pyrotechnic charge, the gases also being used to eject the projectiles. The trip wire reels are mounted flush against one face of a plate, and the ejection system is mounted on a support on the other face of the plate. The support and the plate define a recess containing the movable system and the pyrotechnic charge. projectile is mounted in a chamber, which is provided in the body of the associated trip wire reel and which communicates with the recess of the movable system by a connecting duct. The ejection system is equipped with a timing device to delay the ejection of the projectiles relative to the ejection of the lid, so that the latter does not constitute an obstacle that could be struck by the projectiles. The timing device comprises a pin that blocks the connecting duct. The pin is circumferentially mounted around a piston in a telescopic fashion, the pin and piston assembly forming the movable system. The pin moves integrally during the translational movement of the piston, so that after the lid is cut, the connecting ducts are opened to allow passage of the gas resulting from the triggering of the pyrotechnic charge into the chambers.

Alternatively, the timing device comprises a delayed or slow-burning pyrotechnic charge, located in the connecting duct and triggered by the pyrotechnic charge. In this case, an additional pyrotechnic charge is located at least in the connecting duct, so that the charge is triggered by the slow-burning charge that supplies the gas to eject the projectiles.

The body of the mine has two plane parallel faces, one of which serves as a supporting surface on the ground after the mine comes to rest. In addition, the preferred embodiment of the mine of the present invention comprises two sets of trip wire reels, each located in the vicinity of one of the two flat faces of the body of the mine, as well as two ejection systems, each associated with one of the two sets of reels. At least the ejection system associated with the reels adjacent to the face of the mine which is not in contact with the ground is triggered to eject the associated set of reels, with the other ejection system used to push the mine off the ground before it explodes.

Figure 1:
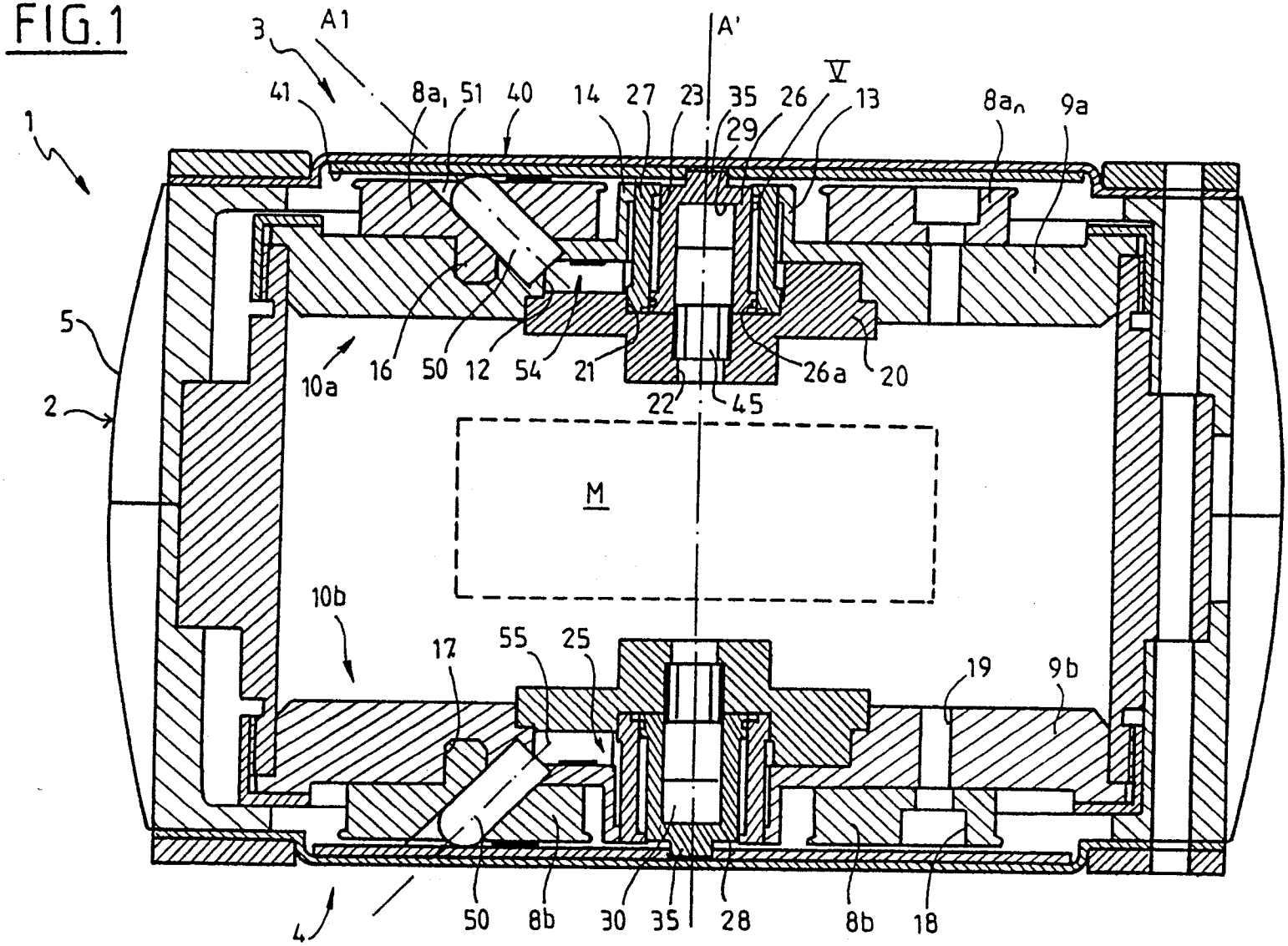
FIG. 1 is a cross section of a preferred embodiment of a trip-wire mine of the present invention.

Mine 1, as shown in FIG. 1, comprises a hollow body 2 housing all of the elements comprising the mine 1. The body 2 is generally cylindrical in shape, with two plane parallel faces 3 and 4 connected to one another by a cylindrical wall 5.

Figure 4:
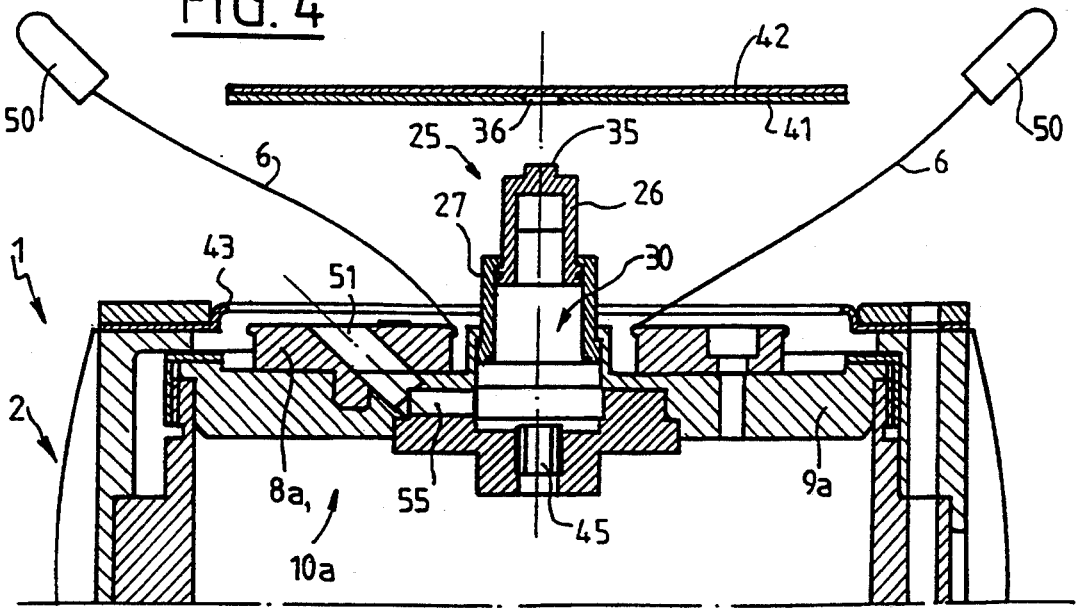

As shown in FIG. 4, mine 1 comprises a plurality of trip wires 6 of a certain length, each trip wire 6 initially being wound on a reel located inside body 2 of mine 1. In the preferred embodiment, as shown in FIG. 1, mine 1 comprises two similar reel assemblies 8*a* and 8*b* mounted on two plates 9*a* and 9*b* located in the vicinity of the two faces 3 and 4 and parallel thereto. These two reel assemblies 8*a* and 8*b* are associated respectively with two ejection systems 10*a* and 10*b* for the trip wires 6. Hence, only the reel assembly 8*a* and the associated ejection system 10*a* will be described below because of the symmetry.

Plate 9*a* of ejection system 10*a* is generally circular in shape, and has an axially inner face (i.e., located facing the inside the mine) having a central recess 12. An axis A extends axially through an opening of a smaller diameter than recess 12 and extends beyond the other, or axially outer face, of plate 9*a* and through the interior of a tubular sleeve 13 projecting from the outer face of plate 9*a*. The free end of sleeve 13 has an internal lip that forms a stop 14.

Figure 9:
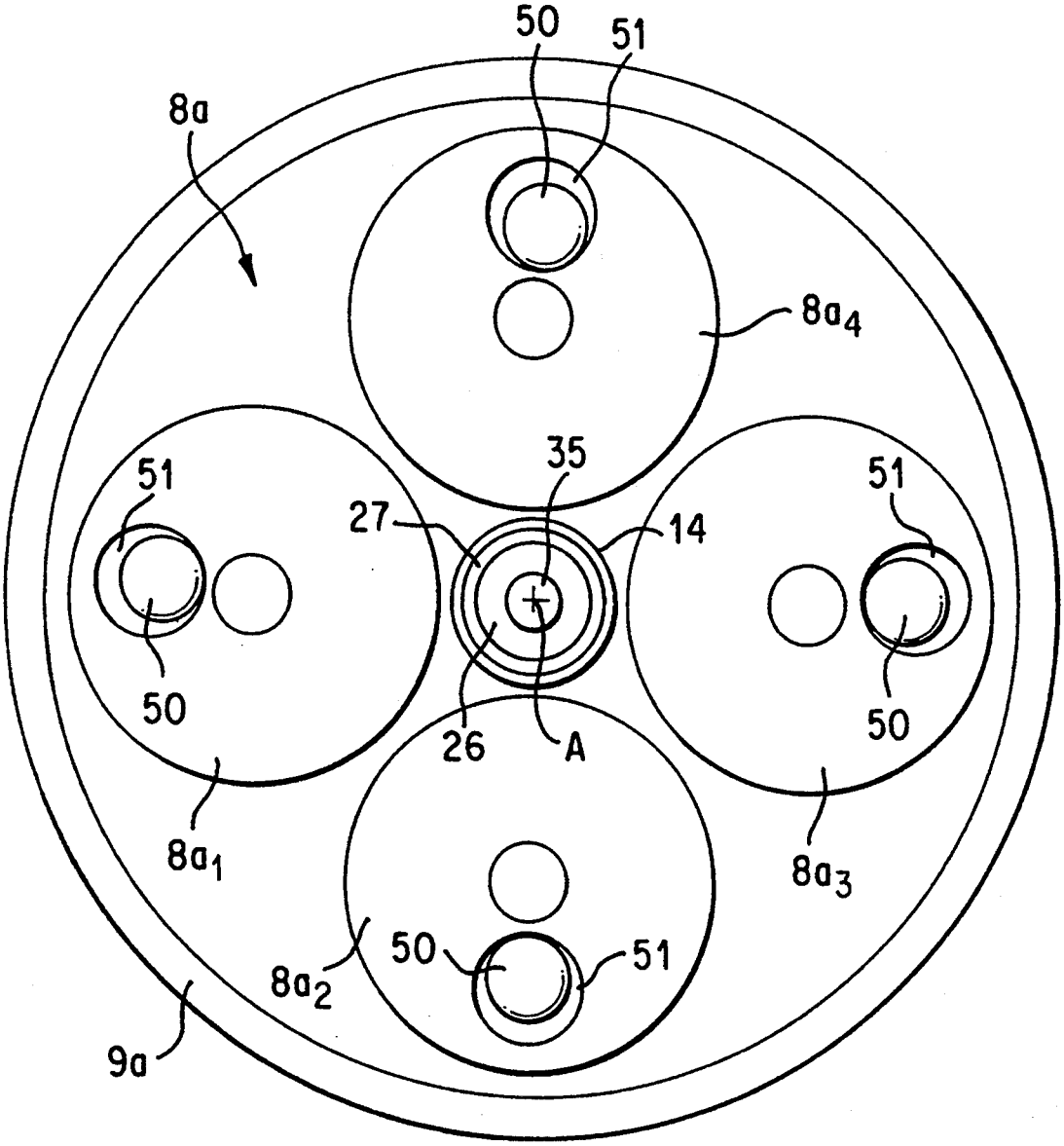
FIG. 9 is an overhead plan view of a reel assembly of the present invention.

As shown in FIG. 9, reels $8a_1$–$8a_n$ of reel assembly 8*a* (for example, 4 reels $8a_1$–$8a_4$) are distributed on the outer face of plate 9*a* around a circle centered on axis A. Each reel $8a_n$ has one of its lateral flanges abutting the outer face of plate 9*a*. The outer face of this contact flange has a central slug 16 that fits into a matching recess 17 in plate 9*a* to center each reel $8a_n$. Each reel $8a_n$ is mounted on plate 9*a* by a mounting means such as a bolt (not shown) that passes freely through an opening 18 in the reel $8a_n$ and is then screwed into a matching threaded opening 19 in plate 9*a*.

Ejection system 10*a* is designed to eject all of the trip wires 6 on reel assembly 8*a* simultaneously and in different directions. To this end, ejection system 10*a* comprises a central part for cutting an opening in one wall of the body 2 of the mine 1, and a peripheral part for ejecting the trip wires 6 through this opening.

The central part of ejection system 10*a* is mounted on a support 20, which is generally circular in shape. The support 20 is partly accommodated in the central recess 12 of plate 9*a* and attached thereto by any appropriate means (not shown).

Support 20 has, on the side facing plate 9*a*, a central circular recess 21 aligned with axis A, the diameter of recess 21 being essentially the same as the inside diameter of sleeve 13. On its other face, support 20 has a central recess 22 of a smaller diameter that terminates at the center of recess 21.

A gap 23 is thus defined by sleeve 13 in plate 9*a* and recess 21 of support 20 to receive the central part of ejection system 10*a* comprising a movable system 25 of the telescopic type, formed by a piston 26 and a pin 27 mounted concentrically around piston 26.

Figure 5:
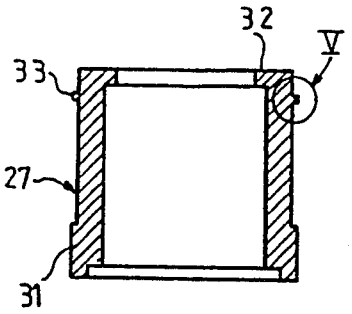
FIG. 5 is an enlarged view of the detail of the area indicated by arrow V in FIG. 1.

Specifically, piston 26 comprises a hollow tubular element closed at one end by a bottom wall 28, and defining an internal chamber 30 whose diameter is essentially the same as that of central opening 22 in support 20. Piston 26 is positioned to freely contact, at its open end, the bottom wall of recess 21 in support 20 while aligned with axis A. At its open end, piston 26 has an external annular boss forming a drive bead 26*a*. Pin 27 likewise freely abuts the bottom wall of recess 21 in support 20 at one end. As shown in FIG. 5, at this same end pin 27 has an external annular boss forming a stop 31, and at its other end an internal annular boss that forms stop 32, with a small collar 33 provided on its external peripheral surface and abutting stop 14 of sleeve 13 on plate 9*a*.

Piston 26 and pin 27 extend essentially to the same height, and when they abut support 20, only central boss 35 provided on the outside of bottom wall 28 of piston 26 projects from sleeve 13.

Face 3 of body 2 of mine 1, which is adjacent to the reel assembly 8*a* and ejection system 10*a*, is formed by a wall 40 mounted at its periphery to body 2 of mine 1.

Figure 2:
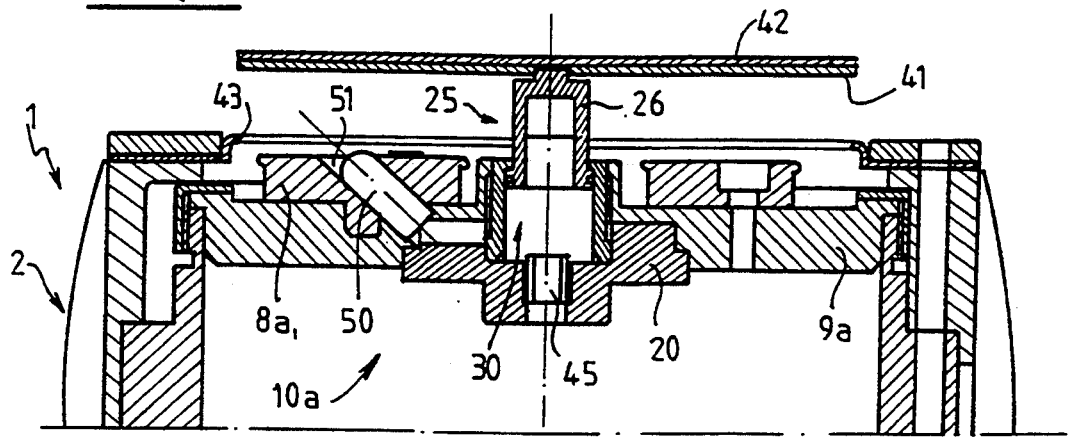
FIGS. 2 to 4 are half views in cross section, to show different phases of ejection of the trip wires.
Figure 3:
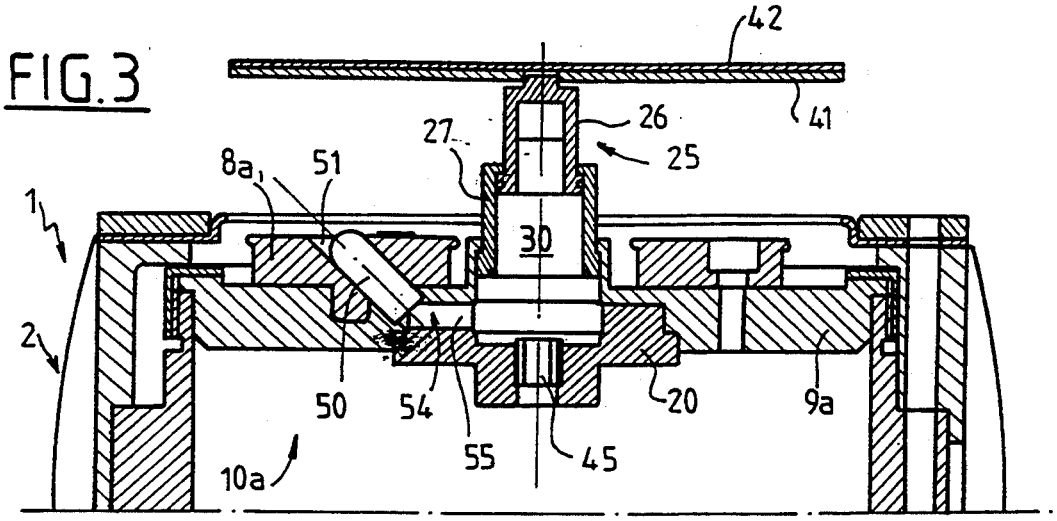

A circular plate 41, with a smaller diameter than wall 40 is connected on one face to wall 40 and connected to piston 26 of movable system 25. Specifically, as shown in FIG. 4, central boss 35 of piston 26 forcibly engages a matching opening 36 provided in the middle of plate 41. As shown in FIGS. 2–4, plate 41 forms a cutting means to cut out a lid 42 in the central part of wall 40 along a diameter corresponding to that of plate 41, thereby defining an opening 43 in wall 40.

A pyrotechnic charge 45 together with its triggering device is mounted inside the opening formed by recesses 21 and 22 of support 20 and is mounted so that the gases that result from its triggering penetrate internal chamber 30 of movable system 25 to displace the latter.

The central part of ejection device 10*a* comprises cutting plate 41 and its control device, comprising movable system 25, which are translationally moved by charge 45 to cut lid 42 out of wall 40. It is supplemented by a peripheral part described below to ensure ejection of trip wires 6 through the opening 43.

One head forming projectile 50 is attached to the free end of each wire 6 and accommodated in an ejection chamber 51. Advantageously, one ejection chamber 51 is provided in the body of each of the reels $8a_n$, in the form of a passage oriented along an oblique axis A1 completely traversing the body of the associated reel $8a_n$. Axis A1 essentially forms a 45° angle with axis A.

Each ejection chamber 51 is closed at one end by cutting plate 41, and communicates at the other end through a connecting duct 54 with gap 23 defined in the central part of ejection system 10*a*.

Each connecting duct 54 is composed of a radial duct 55 formed in support 20. Duct 55 terminates at one end in ejection chamber 51, while its other end is blocked pin 27 of movable system 25. Pin 27 comprises a timing device to delay the arrival of the gases in the ejection chambers 51.

Mine 1 comprises an assembly of means appropriate to its function as a mine, which become operational when the mine detonates (i.e., when one of the trip wires detects the presence of a foreign body). These means have been grouped under reference letter M and will not be described herein, since the invention essentially relates to the system for ejecting the trip wires 6.

The operating principle of this first embodiment of trip-wire ejection system 10*a* of mine 1, with special reference to FIGS. 1 to 5, is described below.

In operation, mines 1 are either ejected from a container or launched using a vector, such as in a filling shell. The vector is often called a "cargo shell" because it can contain several mines. The shell is either fired by an artillery piece on the ground, or launched from an aircraft. As the shell flies over the area to be mined, the mines are ejected from the shell. In all cases, the mines drop in free fall to the ground, and are generally braked by appropriate means known in the art. Once the mines have come to rest on the ground, lying on one of their flat faces, the trip-wire ejection system of each mine 1 is controlled by the internal electronics of the mine 1 to render it operational.

According to the preferred embodiments of the present invention, only one of ejection systems 10*a* or 10*b* needs to be operated to deploy the trip wires 6. For example, as shown in FIGS. 2–4, ejection system 10*a* is employed if the mine rests on the ground on its flat face 4. For this purpose, a detection system (not shown) for the flat face 4 of mine 1 (i.e., the flat face that is in contact with the soil), comprising a mercury relay or the like, shut offs ejection system 10*b* associated with contact face 4. A similar detection system for flat face 3 is also provided.

Charge 45 is triggered by the internal electronics of the mine. The gases resulting from this triggering penetrate internal chamber 30 of piston 26 of movable system 25. As shown in FIG. 2, in a first phase of operation, the pressure of the gases exerted on bottom wall 29 of piston 26 causes a sudden displacement of piston 26, which slides inside pin 27, with pin 27 remaining fixed by means of its small collar 33 contacting stop 14 of sleeve 13 of plate 9*a*. As it is displaced, piston 26 forces cutting plate 41 to cut out lid 42 out of wall 40, along a diameter matching the outside diameter of plate 41. This first phase ends when drive bead 26*a* of piston 26 comes into contact with stop 32 of pin 27. Movable system 25 is then instantaneously immobilized, while the pressure of the gases increases inside the volume defined by chamber 30 of piston 26 and pin 27.

As shown in FIG. 3, in a second phase of operation, the pressure of the gases inside the chamber 30 is such that collar 33 of pin 27 is cut. Pin 27 then becomes movable translationally inside sleeve 13 of plate 9*a*. Piston 26 is again forced to move, and its drive bead 26*a*, in contact with stop 32 of pin 27, causes simultaneous movement of the pin 27, until stop 31 of pin 27 comes into contact with stop 14 of sleeve 13 on plate 9*a*, which has the effect of halting movable system 25. However, the energy accumulated by movable system 25 during its displacement is sufficient to cause the ejection by inertia of cutting plate 41 and lid 42.

As shown in FIG. 4, during its displacement, pin 27 successively frees radial ducts 55 of support 20 to permit passage of the gases into ejection chambers 51 of projectiles 50. The result is the simultaneous ejection of the projectiles 50 through opening 43, with simultaneous unreeling of trip wires 6 wound on reels $8a_1$–$8a_n$ of reel assembly 8*a*.

Mine 1 is then operational, and when one of the trip wires 6 detects the presence of a foreign body, the explosive mechanism of the mine is enabled, in a manner known in the art. Advantageously, the pyrotechnic charge 45 associated with reel assembly 8*b* adjacent to face 4 of mine 1 (i.e., the face that resting on the ground) is initiated immediately before the mine 1 explodes, so that the mine 1 is pushed off the ground. As in the case of ejection system 10a, the gases cause the displacement of movable system 25, cutting of wall 40 of face 4, and by reaction the lifting of the mine 1, which jumps up off the ground before the explosion, thus improving its efficiency.

Figure 6:
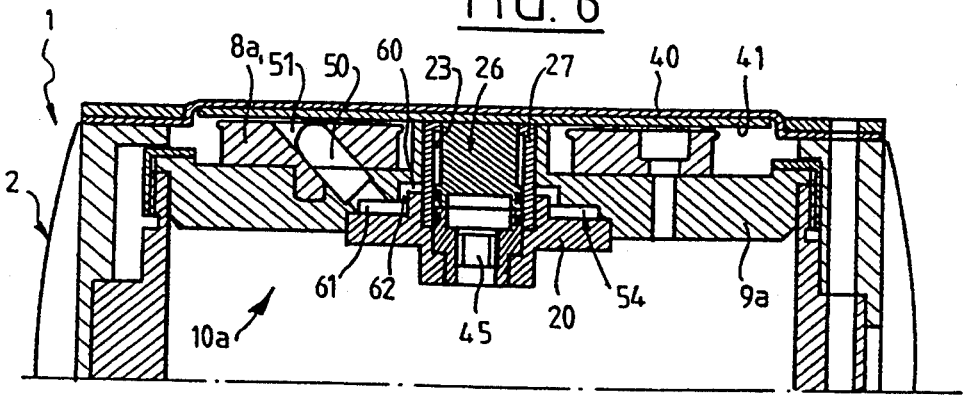
FIG. 6 is a half view in cross section to show a second preferred embodiment of the present invention.

In a second preferred embodiment of the present invention, as shown in FIG. 6, a variation involving a timing device is provided to retard ejection of the projectiles, with the means for cutting and ejecting lid 42 being similar to those described in the first preferred embodiment.

Connecting duct 54, which provides the link between ejection chambers 51 and gap 23 of movable system 25, comprises two annular chambers 60 and 61 centered on axis A, but staggered relative to one another along said axis. Chamber 61, which communicates with ejection chambers 51, is wider than chamber 60. The two chambers 60 and 61 communicate with one another by an annular passageway 62.

Pin 27 of movable system 25 initially seals the passageway between gap 23 and the first chamber 60 of connecting duct 54. After cutting lid 42, displacement of pin 27 by piston 26 opens connecting duct 54. The gases present in gap 23 enter the first chamber 60, where they expand, and then enter the second chamber 61, causing a loss of power. Thus, the combined action of the two chambers 60 and 61 retards the ejection of projectiles 50.

Figure 7:
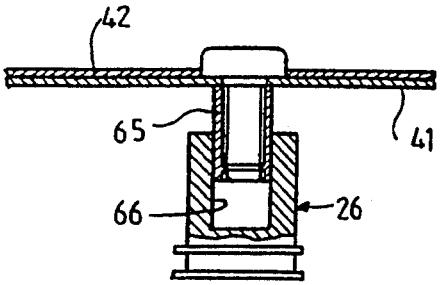
FIG. 7 is an enlarged detailed view of the embodiment shown in FIG. 6.

In this second embodiment, a change is made in cutting plate 41, as shown in FIG. 7. Cutting plate 41 has a central pin 65 located on axis A and partially engaging the interior of a hole 66 provided in the surface of the adjacent end of piston 26. This guide pin 65 makes it possible to improve the cutting of lid 42 by plate 41, which is performed simultaneously over the entire circumference, followed by ejection of lid 42 and cutting plate 41 along axis A (i.e., along the axis of piston 26).

Figure 8:
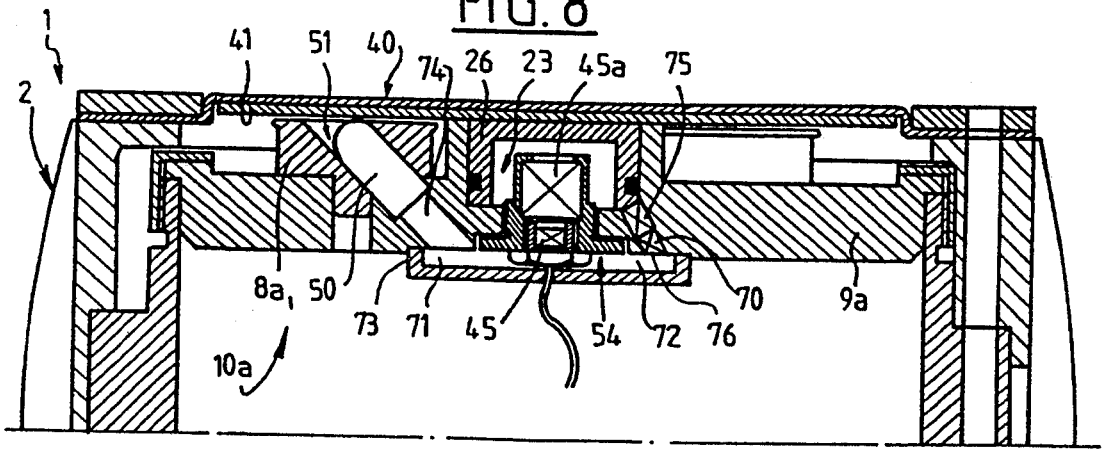
FIG. 8 is a half view in cross section of a third preferred embodiment of the present invention.

According to a third preferred embodiment, as shown in FIG. 8, variations are made involving movable system 25 and the means to eject projectiles 50.

In this third preferred embodiment, movable system 25 is limited to piston 26 which is in direct sliding contact with the inside wall of sleeve 13 of plate 9*a* that supports reels $8a_1$–$8a_n$. Sleeve 13 no longer has the stop 14 for immobilizing the movable system 25 following its displacement. Connecting duct 54 is composed of at least one duct 70 located in plate 9*a* and terminating at one end in gap 23 and, at the other end at the inner face of plate 9*a* (the face opposite that supporting reel assembly 8*a*), a chamber 71 defined by a flange 72 provided with a peripheral lip 73, resting against the inner face of plate 9*a*, and ducts 74, all of which terminate in chamber 71. These ducts 74 are located in plate 9*a* and communicate with ejection chambers 51.

A delayed or slow-burning pyrotechnic charge 75 and an additional classic charge 76 are located in duct 70 adjacent to gap 23, and comprise a timing device.

According to this third preferred embodiment, charge 45, possibly supplemented by an additional charge 45*a*, is triggered to displace piston 26. As in the other embodiments, displacement of piston 26 causes the cutting of a lid 42 by cutting plate 41, but in this case piston 26 is ejected simultaneously with lid 42 and cutting plate 41.

At the same time, combustion of charges 45 and 45*a* triggers slow-burning charge 75 which, following a certain delay, triggers charge 76 whose gases are used to eject projectiles 50. Such a timing device 75 and 76 can of course be used in the other two preferred embodiments described above.

Of course, the invention is not limited to the above embodiments which are provided solely as examples, but comprises all technical equivalents of the means described without departing from the scope of the invention. Specifically, modifications could be made involving cutting plate 41 to facilitate cutting of lid 42.

What is claimed is:

1. A trip-wire mine comprising:

a hollow body accommodating a plurality of trip wires, wherein each trip wire is wound on a corresponding reel; and an automatic trip wire ejection system, the automatic ejection system comprising:

a first device for freeing an opening in a wall of the hollow body of the mine, a plurality of projectiles, each projectile attached to a corresponding free end of one of the plurality of trip wires, and means to eject the plurality of projectiles through the opening in the body of the mine, the plurality of trip wires each simultaneously unreeling from the corresponding reels when the plurality of projectiles are ejected, wherein the first device comprises a cutting means mounted in the body of the mine adjacent the wall to cut a lid from said wall, and a second device for ejecting the lid.

2. A trip-wire mine having a hollow body, a plurality of trip wires and a plurality of projectiles located within said hollow body, each projectile attached to a corresponding free end of one of the plurality of trip wires, the hollow body comprising:

two plane parallel faces, a first one of said two faces serving as a support on a ground; and a cutting means having a cutting plate abutting a second one of said two parallel faces, the cutting means integral with a movable system, said movable system comprising a piston that is telescopically displaceable with a pin along a first axis perpendicular to the cutting plate and passing through a center of the cutting plate, said cutting means cutting the second one of said two parallel faces.

3. The trip-wire mine of claim 2, wherein the movable system further comprises a device for ejecting a lid of the mine, the lid comprising a portion of the second one of said two parallel faces adjacent the cutting means.

4. The trip-wire mine of claim 2, wherein each of the two parallel faces of the hollow body of the mine is formed by a first plate, and wherein the cutting plate has a circular shape, the cutting plate being smaller than the first plate.

5. The trip-wire mine of claim 2, wherein a plurality of trip wire reels are flushly mounted on a first face of a first plate, the plurality of reels distributed in a circle centered on the first axis, and wherein an ejection system is mounted on a support located on a second face of the first plate, said support and said first plate defining a recess centered on the first axis, the movable system mounted in said recess, the movable system movable translationally.

6. The trip-wire mine of claim 5, wherein the piston of the movable system moves translationally along the first axis by, gas pressure of gases resulting from triggering of a pyrotechnic charge, said gases penetrating the recess of the movable system.

7. The trip-wire mine of claim 6, wherein each projectile is mounted in a corresponding ejection chamber oriented along a corresponding second axis, wherein each corresponding second axis forms a substantially 45° angle with the first axis.

8. The trip-wire mine of claim 7, wherein each ejection chamber is formed in the hollow body and is associated with one of the plurality of trip wires.

9. The trip-wire mine of claim 7, wherein the ejection system ejects the projectiles by the gas pressure of the gases resulting from the triggering of the pyrotechnic charge, each ejection chamber communicating to the recess of the movable system through a connecting duct.

10. The trip-wire mine of claim 9, wherein the ejection system further comprises a timing device to delay the arrival of the gases in the ejection chambers.

11. The trip-wire mine of claim 10, wherein the pin forms the timing device, the pin circumferentially mounted around the piston to close the connecting duct, and wherein the pin is connected to the piston in a telescoping fashion to integrally translate with the piston and to open the connecting duct after a lid is cut, the lid comprising a portion of the second one of said two parallel faces adjacent the cutting means.

12. The trip-wire mine of claim 11, wherein the first plate of the ejection system comprises a stop limiting displacement of the movable system, the cutting plate is force-fitted onto the piston, and the lid and the cutting plate are ejected by inertia.

13. The trip-wire mine of claim 11, wherein the movable system, the cutting plate, and the lid are ejected from the hollow body of the mine by the gas pressure of the gases resulting from triggering of the pyrotechnic charge.

14. The trip-wire mine of claim 10, wherein the connecting duct comprises at least two annular chambers forming the timing device.

15. The trip-wire mine of claim 2, further comprising two ejection systems, wherein each ejection system is associated with a corresponding reel assemblies, each reel assembly mounted in the vicinity of one of the two plane parallel faces of the hollow body of the mine.

16. The trip-wire mine of claim 15, wherein the first one of said two faces rests on the ground, the ejection system adjacent to said first face being actuated before detonation of the mine to cause the mine to lift off the ground.

17. A trip-wire mine having a hollow body, a plurality of trip wires and a plurality of projectiles located within said hollow body, each projectile attached to a corresponding free end of one of the plurality of trip wires, the hollow body comprising:

two plane parallel faces, a first one of said two faces serving as a support on a ground;

a cutting means having a cutting plate abutting a second one of said two parallel faces, the cutting means integral with a movable system, said movable system displacable along the first axis perpendicular to the cutting plate and passing through a center of the cutting plate, said cutting means cutting an opening in the second one of said two parallel faces; and an ejection system for ejecting each of the projectiles through the opening in the second one of said two parallel faces.

18. The trip-wire mine of claim 17, wherein a plurality of trip wire reels are flushly mounted on a first face of a first plate, the plurality of reels distributed in a circle centered on the first axis, and wherein said ejection system is mounted on a support located on a second face of the first plate, said support and said first plate defining a recess centered on the first axis, the movable system mounted in said recess, the movable system movable translationally and comprising a piston mounted on the cutting plate.

19. The trip-wire mine of claim 18, wherein the piston of the movable system moves translationally along the first axis by gas pressure of gases resulting from triggering of a first pyrotechnic charge, said gases penetrating the recess of the movable system.

20. The trip-wire mine of claim 19, wherein each projectile is mounted in a corresponding ejection chamber oriented along a corresponding second axis, wherein each corresponding second axis forms a substantially 45° angle with the first axis.

21. The trip-wire mine of claim 20, wherein each ejection chamber is formed in the hollow body and is associated with one of the plurality of trip wires.

22. The trip-wire mine of claim 21, wherein the ejection system ejects the projectiles by a gas pressure of gases resulting from triggering of at least one second pyrotechnic charge, wherein each ejection chamber communicates by a connecting duct with the recess of the movable system, said at least one second charge being located in the connecting duct.

23. The trip-wire mine of claim 22 wherein the ejection system further comprises a timing device to delay the triggering of the at least one second pyrotechnic charge.

24. The trip-wire mine of claim 23, wherein the timing device comprises a slow-burning pyrotechnic charge located in the connecting duct, said slow burning charge triggered by combustion of the first pyrotechnic charge and triggering the at least one second charge.

25. The trip-wire mine of claim 22, wherein the piston is ejected simultaneously with a lid of the mine, the lid comprising a portion of the second one of said two parallel faces adjacent the cutting means.

* * * * *